US005993325A

United States Patent [19]

Heyer

[11] Patent Number: 5,993,325

[45] Date of Patent: Nov. 30, 1999

[54] FLEXIBLE SWING WEIGHT

[76] Inventor: Mike W. Heyer, 728 NE. 87th Ave., #B-8, Portland, Oreg. 97220

[21] Appl. No.: 08/950,257

[22] Filed: Oct. 14, 1997

[51] Int. Cl.[6] ..... A63B 69/36; A63B 69/38

[52] U.S. Cl. ..... 473/256; 473/519

[58] Field of Search ..... 473/256, 519

[56] References Cited

U.S. PATENT DOCUMENTS

| | | | |
|---|---|---|---|
| D. 260,921 | 9/1981 | Mena . | |
| D. 290,150 | 6/1987 | Stewart . | |
| D. 367,511 | 2/1996 | James . | |
| 3,608,907 | 9/1971 | Bouchard | 473/256 X |
| 3,982,755 | 9/1976 | Sarich . | |
| 4,090,716 | 5/1978 | Martin et al. | 473/384 X |
| 4,461,479 | 7/1984 | Mitchell . | |
| 4,575,074 | 3/1986 | Damratoski . | |
| 4,588,191 | 5/1986 | Stewart . | |
| 4,593,903 | 6/1986 | Waitz . | |
| 4,690,399 | 9/1987 | Hayashi . | |
| 4,842,280 | 6/1989 | Hilton . | |
| 4,949,955 | 8/1990 | Keen . | |
| 4,949,957 | 8/1990 | Cucchiara . | |
| 4,971,305 | 11/1990 | Rennex . | |
| 5,178,394 | 1/1993 | Tanampai . | |
| 5,334,118 | 8/1994 | Dantolan . | |
| 5,374,062 | 12/1994 | Kochevar . | |
| 5,470,055 | 11/1995 | Ritchie . | |
| 5,484,156 | 1/1996 | Giguere . | |
| 5,496,240 | 3/1996 | Damm . | |
| 5,588,923 | 12/1996 | Schmidt et al. . | |
| 5,632,709 | 5/1997 | Walsh . | |

OTHER PUBLICATIONS

Copy of Falconwood swing weight and packaging therefor, marketed by ProActive Sports, Inc., Canby, Oregon, 2 pages, publication date unknown.

*Primary Examiner*—George J. Marlo
*Attorney, Agent, or Firm*—Dellett and Walters

[57] ABSTRACT

A flexible swing weight comprises an elongate member with a diameter between ¼ and ¾ inches and a length of between 3 and 7 inches manufactured of a flexible, heavy material, such as extruded lead. An elastomeric coating is provided on the weight and the swing weight is secured to a golf club by wrapping the weight around a shaft of the club. For a stringed exercise device such as a racket or the like, the swing weight can be attached by weaving the weight through the strings of the exercise device to add additional weight to the device during practice or warm-up.

8 Claims, 2 Drawing Sheets

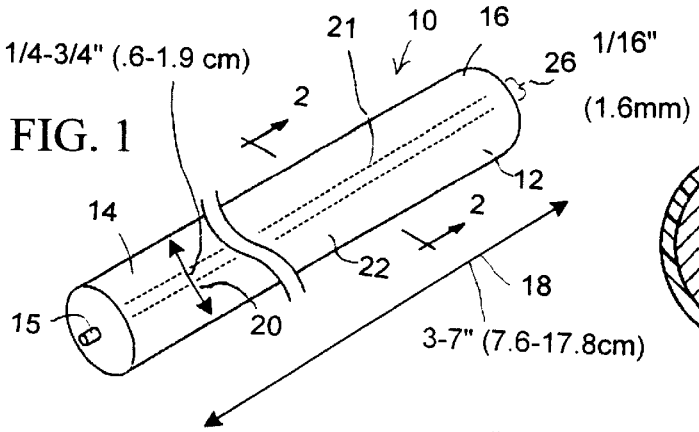
FIG. 1
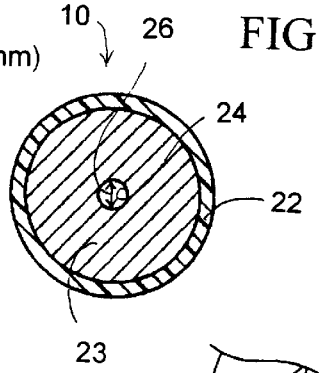
FIG. 2
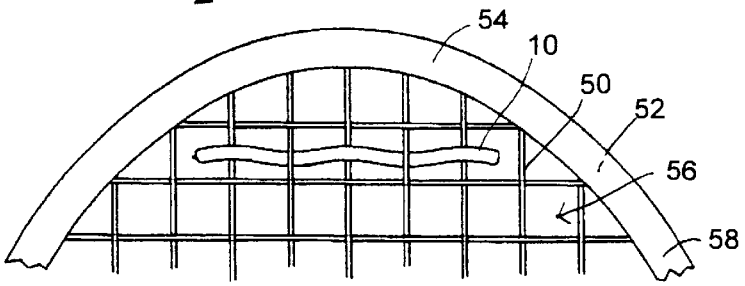
FIG. 5
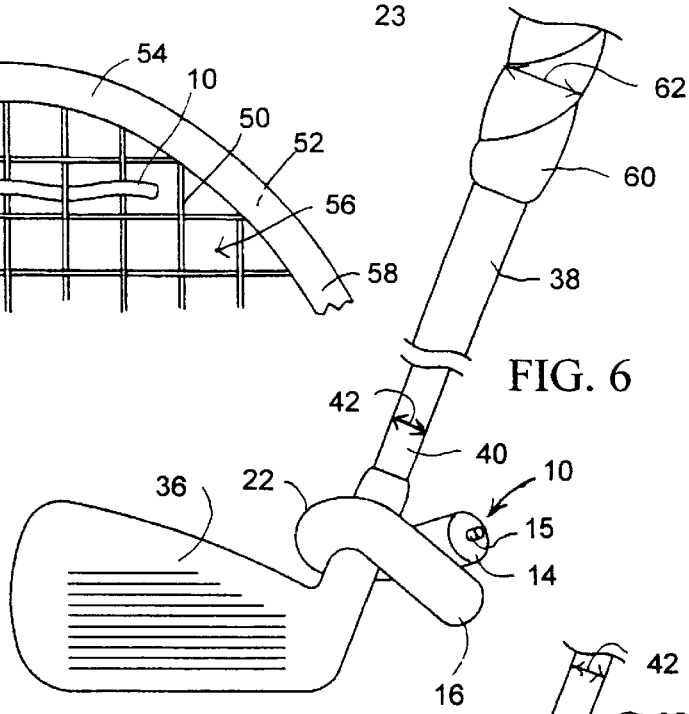
FIG. 6
FIG. 3
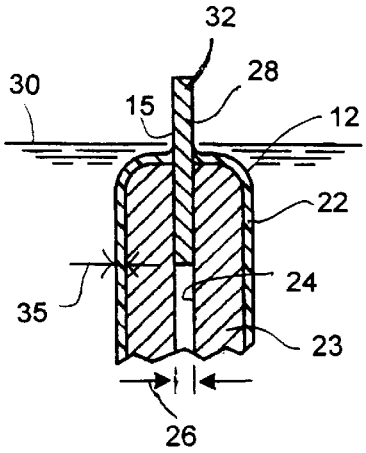
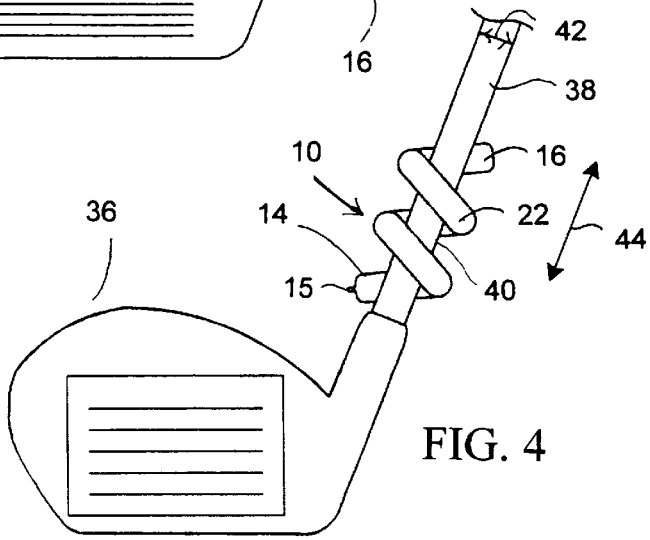
FIG. 4

FLEXIBLE SWING WEIGHT

BACKGROUND OF THE INVENTION

This invention relates to a swing weight, and more particularly, to a flexible swing weight that may be attached to an exercise device, such as recreational equipment including a tennis racquet or a golf club, to add additional weight to the exercise device during practice or warm-up.

Conventional swing weights may comprise a rigid doughnut shaped weight that is slipped over the handle and down the shaft of a golf club to add weight to the head of the club during practice or warm-up. Such an installation procedure may damage the expensive grip of the golf club. Moreover, the diameter of the golf club grip is usually substantially larger than the diameter of the club shaft at a position adjacent the head of the golf club. Accordingly, during swinging of the golf club the doughnut shaped swing weight may shift about the shaft of the club and result in an awkward or an unnatural swing. In addition, the rigid design of the doughnut shaped swing weight is generally only adaptable for use on a single exercise device, such as a golf club, and may not be used on other exercise devices, such as a tennis racquet, which may have a substantially larger grip than the grip of a golf club.

SUMMARY OF THE INVENTION

The present invention provides an improved swing weight that is flexible so as to be securely fastened to a variety of exercise devices, does not shift during use and does not damage the grip region of the exercise device during installation. In a preferred embodiment the swing weight comprises an elongate member manufactured of a weighted, flexible material, such as lead, and having a hollow core. The hollow core facilitates flexing of the weight and allows for insertion of a hanger for dipping the weight into a tank of elastic coating material. The elastic coating of the swing weight extends along the length of the weight and acts to frictionally grip an exercise device during use.

In accordance with the invention, an object of the present invention is to provide an improved swing weight that may be attached to an exercise device to add additional weight to the device during practice or warm-up.

It is another object of the present invention to provide an improved swing weight that is flexible so as to fit a variety of exercise devices.

It is a further object of the present invention to provide an improved swing weight that may be wrapped directly around the shaft of an exercise device without damaging the grip region of the device.

It is still a further object of the present invention to provide an improved swing weight that may be woven through the strings of an exercise device.

It is yet another object of the present invention to provide an improved swing weight that does not shift on an exercise device during swinging of the device.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 1 is a perspective view of the flexible swing weight in a straight configuration;

FIG. 2 is a cross sectional end view of the flexible swing weight taken along line 2—2 of FIG. 1;

FIG. 3 is a cross sectional side view of the flexible swing weight having a hanger secured within the hollow core so as to facilitate dipping of the weight into a tank of coating material;

FIG. 4 is a side view of the flexible swing weight secured in a helical wind configuration around the shaft of a golf club;

FIG. 5 is a top view of the flexible swing weight secured in a woven configuration through the strings of a tennis racquet;

FIG. 6 is a side view of the flexible swing weight secured in a circular bend configuration around the shaft of a golf club.

DETAILED DESCRIPTION

Figure 7:
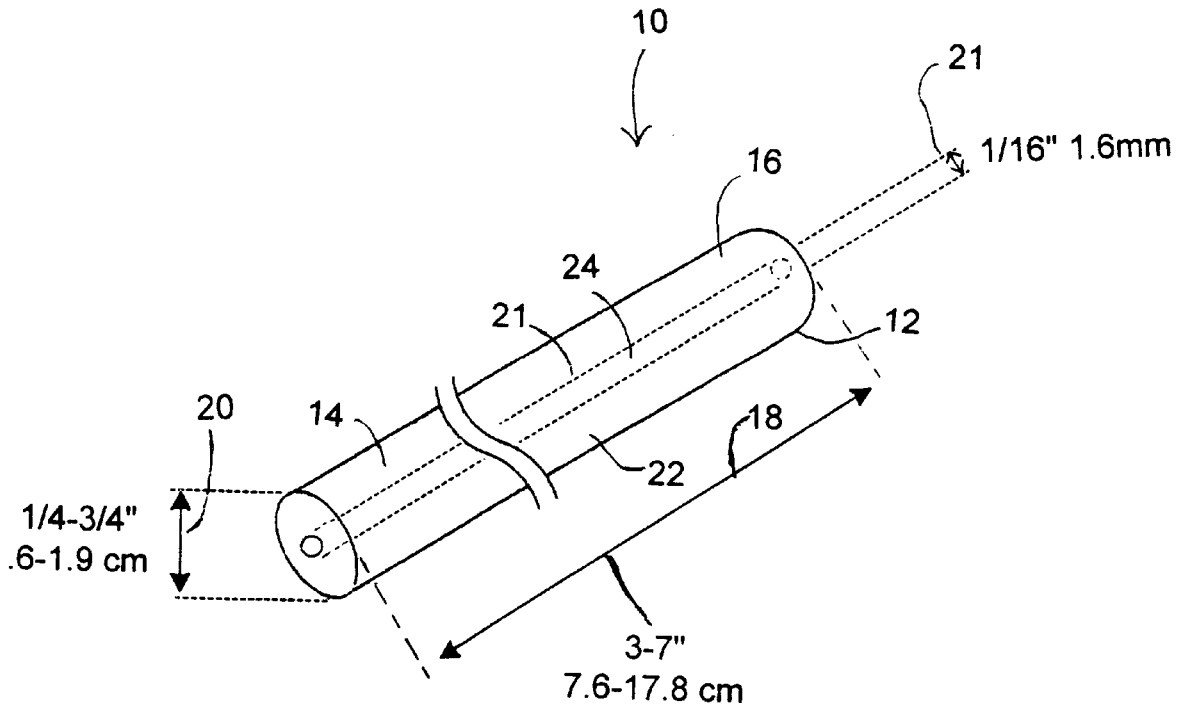
FIG. 7 is a perspective view of the flexible swing weight without a nubbin, in a straight configuration.

Referring to FIG. 1, which is a perspective view of the flexible swing weight in a straight configuration, flexible swing weight 10 comprises an elongate body 12 including a first end 14, having a nubbin 15, and a second end 16. The ends may be rounded when the body is manufactured through use of a mold or the ends may be flat surfaces when the body is cut from an extruded length of material. Body 12 has a length 18 in a range of approximately 3.0 to 7.0 inches (in) (7.6 to 17.8 centimeters (cm)), and preferably 5.5 inches (in) (14.0 centimeters (cm)), and a diameter 20 in a range of approximately ¼ to ¾ in (0.6 to 1.9 cm), and preferably 5/16 in (0.8 cm). The preferred embodiment is particularly well suited for use of the device on the shaft of a golf club, as will be described below.

Weight 10 may be extruded from lead or any like flexible, heavy material with relatively little memory that may be bent into a desired configuration and thereafter remain in that configuration. For example, when weight 10 is extruded from lead, the lead may be bent backwardly upon itself under an external force. Upon removal of the external force, the weight will remain in the bent configuration for an extended time. In application, the weight may be bent into a helical configuration around the shaft of a golf club, woven through the strings of a tennis racquet or bent backwardly upon itself around the shaft of a golf club. In the preferred embodiment, wherein the weight is extruded from lead, swing weight 10 has a weight of approximately 2.5 ounces (70.8 grams). A hollow core 24 centered and running through the longitudinal axis of the weight is formed in the extrusion process. Hollow core 24 is illustrated with phantom line 21 and has a diameter 26 of approximately 1/16 in (1.6 millimeters).

Still referring to FIG. 1, weight 10 further comprises an outer coating 22 that generally completely surrounds elongate body 12. The coating preferably is an elastic, flexible material, such as vinyl, that provides a protective coating for the weight, a protective coating for an exercise device upon which the weight is secured, improved frictional contact of the weight with an exercise device and improved grippability of the weight when handled. The coating material typically is coated on the weight by dipping body 12 into a tank of the coating material which may be in a powdered form or in a molten liquid form, as is well known in the art.

Referring to FIG. 2, which is a cross sectional end view of the flexible swing weight taken along line 2—2 of FIG. 1, swing weight 10 includes a weighted material 23 that defines a hollow core 24 having a diameter 26 of approximately 1/16 in (1.6 millimeters) (reference FIG. 1). In the preferred embodiment, wherein the swing weight is manufactured by the process of extrusion, hollow core 24 extends along the full length 18 of the weight. In this embodiment, hollow core 24 is believed to aid in flexing of the weight because the core may be compressed or change shape in the region of a bend of the weighted material. Those skilled in the art will understand of course that due to the flexibility of weighted material 23, a hollow core is not required for bending of the swing weight.

In the embodiment wherein weight 10 is manufactured by use of a mold, core 24 may extend inwardly from an end of the weight a distance of approximately 1.0 in (2.54 cm). In both embodiments, i.e., when the core extends the full length or when the core extends along only a portion of the member, the core facilitates dipping of the weight into a coating material, as will be described below.

Referring to FIG. 3, which is a cross sectional side view of the flexible swing weight having a hanger secured within the hollow core so as to facilitate dipping of the weight into a tank of coating material, swing weight 10 is shown with a hanger 28 secured within hollow core 24. Hanger 28 may comprise a wire that is frictionally received within the core, a flexible line such as fishing line that is glued within the core or a threaded fastener that is threadably secured within the core. In another embodiment, hanger 28 may be a wire or a flexible line that extends along the full length of the core so that several weights can be simultaneously secured in series on a single hanger. In the preferred embodiment, hanger 28 is a metallic wire that has a diameter so as to be frictionally received within hollow core 24 of a single weight.

To apply elastic outer coating 22 to body 12, hanger 28 is secured within core 24. Body 12 is then suspended by the hanger and dipped into a tank containing coating material 30. When hanger 28 supports a single body 12, the body generally is dipped vertically into the coating tank. When hanger 28 supports several bodies 12 in series, the bodies generally are simultaneously dipped horizontally into the coating tank. In the preferred embodiment, coating material 30 is molten vinyl which adheres to elongate body 12 to form coating 22. In other embodiments, the coating material may be in powdered form wherein the powder gels on weighted material 23 to form coating 22. Weight 10 is then removed from the tank of coating material, suspended by the hanger and allowed to dry or cure.

Upon complete drying or curing of outer coating 22, a portion 32 of wire hanger 28 that extends beyond end 14 or 16 is cut to define nubbin 15. The hanger preferably is cut as close as possible to body 12 so as to minimize the size of nubbin 15. In another embodiment, the wire hanger may be completely removed from the frictional fit within the hollow core so that both ends of the swing weight are generally smooth. In yet another embodiment wherein hanger 28 is a threaded fastener, the fastener may be threadably removed from the weight so that the final product does not include a nubbin.

Coating 22 may be coated on body 12 to a thickness 35 of approximately 1/16 in (16 millimeters). Those skilled in the art will understand that the coating may be coated on the body to any desired thickness for a particular application. Moreover, the coating may be manufactured in any color or combination of colors so as to give swing weight 10 a pleasing aesthetic appearance. In addition, coating 22 may have a rough, textured outer surface so as to improve the grippability of the weight when handled or to improve the frictional contact of the weight with an exercise device when mounted thereon.

Referring to FIG. 4, which is a side view of the flexible swing weight secured in a helical wind configuration around the shaft of a golf club, swing weight 10 is shown secured adjacent a head region 36 of a golf club 38. The flexibility of swing weight 10 enables the weight to be snugly wound in a helical configuration around a shaft 40 of the golf club so that the swing weight securely contacts the shaft about its diameter 42. The flexibility of the swing weight also enables the weight to securely fit virtually any sized diameter golf club shaft. Due to the snug fit of the weight around the shaft diameter, during swinging of golf club 38 the swing weight will not shift radially on the golf club shaft. Due to the snug fit and due to elastic coating 22, the swing weight is generally frictionally secured against longitudinal movement in the directions of arrow 44 along the golf club shaft. Moreover, due to the frictional engagement between elastic coating 22 and the shaft of the club, the swing weight may be frictionally placed on shaft 40 at a position upwardly from head region 36 of the golf club because the frictional force between the coating and the club shaft will be greater than the centrifugal force exerted on the weight as the exercise device swings through an arc. Swing weight 10 provides, therefore, for a smooth, natural swing of an exercise device during practice or warm-up wherein additional weight is mounted on the device. The swing weight also provides for placement of the swing weight at any desired position along the length of the shaft of the exercise device so as to adjust the effective weight of the additional weight added to the device. In other words, placement of the weight towards the head of a golf club will result in a greater torque during swinging of the device than placement of the weight towards the grip of the golf club.

In use, swing weight 10 typically is secured to the exercise device to build strength and to stretch or flex muscles past their normal stretch or flex points. As will be understood by those skilled in the art, weight 10 may be secured around the shaft of virtually any exercise device such as a hockey stick, a lacrosse stick, a polo mallet, or the like.

Referring to FIG. 5, which is a top view of the flexible swing weight secured in a woven configuration through the strings of a tennis racquet, swing weight 10 may be woven through the strings 50 of a tennis racquet 52 adjacent its top edge region 54. The flexibility of the swing weight permits the weight to be threaded over and under adjacent strings so as to securely fasten the weight in place. Positioning of the weight at top edge region 54 will evenly increase the weight of the racquet across the racquet face 56. In another embodiment the weight may be woven through the strings along a side edge region 58 of the racquet. Such positioning of the weight will unevenly increase the weight of the racquet across the racquet face which may facilitate practicing slice shots or shots with topspin. For use on racquets, the swing weight preferably is manufactured with a length 18 of approximately 6.6 in (16.5 cm) and a diameter 20 of approximately 1/4 in (0.6 cm). As will be understood by those skilled in the art, weight 10 may be secured through the strings of any stringed exercise device such as a racquetball racquet, a squash racquet, a lacrosse stick net, or the like. The end of the swing weight may also be bent around and encircle a group of strings of an exercise device or may encircle a frame of the exercise device such that the weight is secured to the stringed device without weaving the weight over and under adjacent strings.

Referring to FIG. 6, which is a side view of the flexible swing weight secured in a circular bend configuration around the shaft of a golf club, weight 10 is shown bent backwardly and around upon itself. The flexibility of swing weight 10 enables the weight to be snugly wound in a circular configuration around shaft 40 of the golf club so that the swing weight securely contacts the shaft about its diameter 42. Accordingly, during swinging of golf club 38 the swing weight will not shift radially on the golf club shaft. Swing weight 10 provides, therefore, for a smooth, natural swing of an exercise device while adding additional weight to the exercise device during practice or warm-up. For this type of application, the swing weight preferably is manufactured with a length 18 of approximately 4.0 in (10.2 cm) and a diameter 20 of approximately ½ in (1.3 cm). Those skilled in the art will understand of course that a single embodiment of the present invention, due to its flexibility, can be utilized for attachment in a variety of ways to several different exercise devices.

Still referring to FIG. 6, in use, swing weight 10 is secured to the exercise device by placing the weight directly around shaft 40 of the golf club. The weight is then bent backwardly upon itself to snugly encircle diameter 42 of the golf club shaft. Accordingly, swing weight 10 is secured to an exercise device without moving the device downwardly over a grip region 60 of the golf club which has a diameter 62 substantially larger than diameter 42 of the shaft adjacent head region 36. The flexibility of the swing weight, therefore, allows the weight to be releasably secured to an exercise device without damaging the expensive grip region of the device. Moreover, the swing weight can be used on drivers, irons and putters, as will be understood by those skilled in the art.

Referring to FIG. 7, a perspective view of the flexible swing weight without a nubbin, in a straight configuration, the dimensions of the embodiment without a nubbin can be seen.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A weight for attaching to a golf club, comprising:

an elongate member including a coating thereon and having a length defined by its opposite ends which are spaced apart a distance in a range of 3 to 7 inches and a diameter in the range of ¼ to ¾ inches, manufactured of a flexible, weighted material, said member being capable of flexing to releasably engage a shaft of a golf club for attaching the member thereto.

2. A weight according to claim 1 wherein said elongate member includes a length and a hollow core extending along at least a portion of said length.

3. A weight according to claim 2 wherein said hollow core extends substantially along the entire length of the elongate member.

4. A weight according to claim 1 wherein said coating comprises an elastic coating on said elongate member.

5. A weight according to claim 1 wherein said elongate member is manufactured of lead.

6. A weight for attaching to a piece of recreational equipment, comprising:

an elongate member with a plastic coating thereon, said member and coating together including a length defined by its opposite ends which are spaced apart a distance in a range of 3 to 7 inches and a diameter in the range of ¼ to ¾ inches with a hollow core extending along at least a portion of said length, said member manufactured of a bendable, weighted material, said member being capable of bending over and under adjacent strings of a piece of recreational equipment for securing the member thereto.

7. A weight according to claim 6 wherein said elongate member includes a length and a hollow core extending generally along the length of said member.

8. A weight according to claim 6 wherein said elongate member is manufactured of lead.

* * * * *